US005730439A

United States Patent [19]

Salomon

[11] Patent Number: 5,730,439

[45] Date of Patent: Mar. 24, 1998

[54] SHEET FEEDER

[75] Inventor: James A. Salomon, Cheshire, Conn.

[73] Assignee: Pitney Bowes Inc., Stamford, Conn.

[21] Appl. No.: 680,412

[22] Filed: Jul. 15, 1996

[51] Int. Cl.[6] ..... B65H 3/56

[52] U.S. Cl. ..... 271/122; 271/121; 271/124

[58] Field of Search ..... 271/121, 122, 271/125

[56] References Cited

U.S. PATENT DOCUMENTS

| | | | |
|---|---|---|---|
| 2,887,316 | 5/1959 | Tobey | 271/125 |
| 3,044,770 | 7/1962 | Breuers | 271/122 |
| 3,831,928 | 8/1974 | Davis | 271/35 |
| 3,949,979 | 4/1976 | Taylor | 271/10 |
| 4,052,051 | 10/1977 | Merseareau | 271/94 |
| 4,192,498 | 3/1980 | Toto | 271/21 |
| 4,290,593 | 9/1981 | Irvine | 271/42 |
| 4,368,881 | 1/1983 | Landa | 271/122 |
| 4,522,385 | 6/1985 | Stefansson | 271/10 |
| 4,613,127 | 9/1986 | Wishart | 271/274 |
| 4,909,499 | 3/1990 | O'Brien | 271/10 |
| 4,930,764 | 6/1990 | Holbrook | 271/119 |
| 4,973,037 | 11/1990 | Holbrook | 271/2 |
| 4,978,114 | 12/1990 | Holbrook | 271/35 |
| 5,050,854 | 9/1991 | Tajima | 281/122 |
| 5,088,718 | 2/1992 | Stepan | 271/161 |
| 5,172,900 | 12/1992 | Uno et al. | 271/125 |
| 5,374,048 | 12/1994 | Takahashi | 271/125 |

FOREIGN PATENT DOCUMENTS

| | | | |
|---|---|---|---|
| 0211248 | 9/1986 | Japan | 271/122 |
| 405170349 A | 7/1993 | Japan | 271/122 |
| 406156785 | 6/1994 | Japan | 271/122 |

*Primary Examiner*—H. Grant Skaggs

*Attorney, Agent, or Firm*—Angelo N . Chaclas; Melvin J. Scolnick

[57] ABSTRACT

A sheet feeder including a rotateable feed roller for feeding sheets in a path of travel and retarding apparatus operatively coupled with the feed roller for forming a nip therebetween; wherein the retarding apparatus rotates along with the feed roller when a single sheet is in the nip and the retarding apparatus does not rotate when a plurality of sheets are in the nip.

4 Claims, 4 Drawing Sheets

SHEET FEEDER

FIELD OF THE INVENTION

This invention relates to article feeding apparatus. More particularly, this invention is directed to repeatedly removing a sheet from a stack of sheets.

BACKGROUND OF THE INVENTION

In most paper handling equipment (such as: printers, copiers, facsimile machines, mailing machines, inserters, etc.) there is an apparatus for repeatedly feeding sheets from a supply or stack of sheets. Paper handling equipment is typically characterized by the functions it performs and the different types of sheets (cut copy or print sheets, original sheets, envelopes, post cards, checks, etc.) which it operates on. Generally, it is desirable to remove a single sheet from the stack and thereafter perform one or more functions on the sheet. The process of removing an individual sheet from the stack is commonly referred to in the industry as singulation and the apparatus which performs this function is commonly referred to as a sheet feeder or singulator. As the singulation process is repeated, a stream of individuals sheets is created. In this manner, a high degree of automation is achievable.

The efficiency of the sheet feeder is measured by: (1) its ability to consistently singulate and feed sheets from a stack without producing misfeeds; and (2) the speed at which the sheet feeder operates. One type of common misfeed to be avoided is a multi-feed which occurs when two or more sheets are removed from the stack and fed downstream together. This causes problems for the paper handling equipment, such as jams, which often require operator intervention to correct. Another type of common misfeed is a stall which occurs when the sheet feeder fails to feed any sheet at all. Therefore, it is desirable to have the sheet feeder operate within a processing window between stalls and multi-feeds where only single sheets are feed downstream.

Additionally, it is desirable to have the sheet feeder operate at high speed so that overall throughput of the paper handling equipment because a reliable and fast sheet feeder results in more efficient and cost effective paper handling equipment. However, increasing the speed of the sheet feeder often has the resulting negative consequence of increasing the likelihood of misfeeds. Additionally, the problem of misfeeds is complicated by a number of other factors. For example, static electricity, adhesion/cohesion and frictional drag between the sheets all act to generate a tendency for the sheets to remain together and resist singulation.

Various different types of sheet feeders are known in the prior art which seek to address these problems. One type of sheet feeder employs a drive roller and an opposing retarding roller to form a nip through which sheets are fed. The drive roller rotates in one direction to feed sheets downstream along a desired feed path while the retarding roller constantly rotates in an opposite direction to prevent misfeed sheets from advancing. The drive roller is selected to have a high coefficient of friction with respect to the sheet while the retarding roller has a coefficient of friction with respect to the sheet which is lower than that of the drive roller. However, the coefficient of friction between the retarding roller and the sheet is greater than the coefficient of friction between two sheets. In this manner, the drive roller is capable of feeding a single sheet past the retard roller due to its relatively high coefficient of friction. On the other hand, if two sheets enter the nip between the drive roller and the retard roller, the sheet adjacent the drive roller will slip past the other sheet and continue downstream while the retard roller detains the other sheet.

This type of sheet feeder suffers from several drawbacks. Because the retard roller is constantly scrubbing against the sheets, excessive paper dust is created and the retard roller tends to wear out quickly. Additionally, the desired relationship between the coefficients of friction changes over time due to paper dust and other contaminants becoming impregnated in the rollers and the change in material properties over time. This impacts the efficiency and reliability of the sheet feeder by narrowing the operating range of the overall system.

Another type of sheet feeder is known which also employs a drive roller and a retard roller. Here, the drive roller still rotates in one direction, but the retard roller is not constantly rotated in the opposite direction. Instead, the retarding roller is free to rotate in both directions and a torque is applied to the retarding roller. The applied torque is selected so that it is sufficient to separate two sheets in the nip, but is not sufficient to overcome the frictional force due to a single sheet in the nip. Thus, if one a single sheet is in the nip, then the drive roller not only feeds the single sheet but also overcomes the applied torque and causes the retard roller to rotate in cooperative fashion. On the other hand, if two sheets are in the nip, then the applied torque separates the sheets and the retard roller rotates opposite to the drive roller preventing the sheet it is in contact with from advancing. Examples of this type of feeder are shown in U.S. Pat. Nos. 4,368,881 and 5,050,854 which employ a torsion spring and a motor, respectively, to produce the applied torque.

Although this type of sheet feeder generally works well, it also suffers from several drawbacks. Generally, slip clutches are required which add to the overall cost and assembly time of the sheet feeder. With respect to spring based systems, a sequence of successful sheet feeds is required to fully load the spring. Therefore, the system is vulnerable to misfeeds during the period when the spring is not fully wound. Additionally, this type of sheet feeder is also sensitive to changes in the coefficient of friction of the retard roller.

As a result, there is a need for an improved sheet feeder which singulates sheets from a stack thereof and feeds them downstream in a reliable and cost effective manner. Also, there is a need for an improved sheet feeder which exhibits improved wear, less noise and reduced sensitivity to the frictional coefficient of the retard roller. Moreover, there is a nee for an improved sheet feeder which has a large processing window between stalls and misfeeds so that the sheet feeder may accommodate a wide variety of sheet materials and finishes.

SUMMARY OF THE INVENTION

Accordingly, it is an object of the present invention to substantially overcome the disadvantages of the prior art.

In accomplishing these and other objects there is provided a sheet feeder including a rotatable feed roller for feeding sheets in a path of travel and retarding apparatus operatively coupled with the feed roller for forming a nip therebetween; wherein the retarding apparatus rotates along with the feed roller when a single sheet is in the nip and the retarding apparatus does not rotate when a plurality of sheets are in the nip.

Therefore, it is now apparent that the invention achieves all the above objects and advantages. Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. As shown throughout the drawings, like reference numerals designate like or corresponding parts.

DETAILED DESCRIPTION OF THE PREFERRED EMBODIMENTS

Figure 1A:
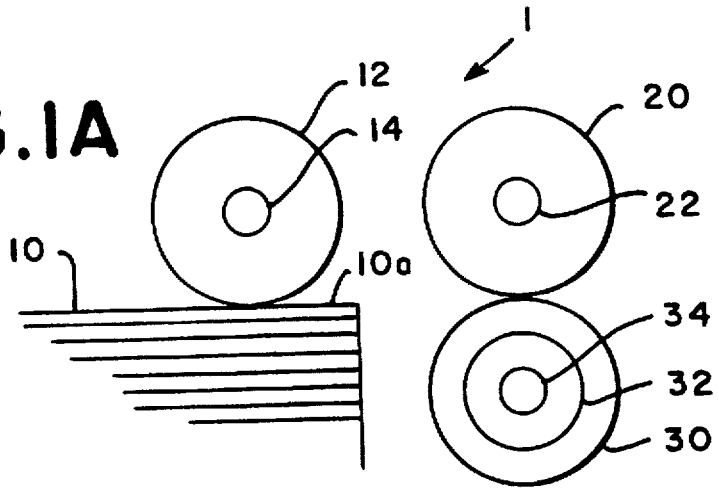
FIG. 1A is a simplified illustration of a front view of a sheet feeder in accordance with a first embodiment of the present invention.

Referring to FIG. 1A, a first embodiment of a sheet feeder 1 in accordance with the present invention is shown. A nudger roller 12 is fixably mounted to a shaft 14 and positioned to contact a stack of sheets 10. The shaft 14 is connected to a conventional drive means (not shown) to cause the nudger roller 12 to rotate in a counter-clockwise direction in response to a sheet feed instruction supplied by a suitable control system (not shown). Generally, a conventional biasing means, such as a spring (not shown), keeps the nudger roller 12 in intimate contact with a top sheet 10*a* of the stack 10. As the nudger roller 12 rotates counter-clockwise, frictional forces between the nudger roller 12 and the top sheet 10*a* cause the top sheet 10*a* to move off the stack 10.

Located downstream from and in general horizontal alignment with the nudger roller 12 is a feed roller 20 fixably mounted to a shaft 22. The shaft 22 is connected to a conventional drive means (not shown) to cause the feed roller 20 to rotate in a counter-clockwise direction in either continuous fashion or in relation to the sheet feed instruction which actuates the nudger roller 12. A retard roller 30 is biased toward and in operative engagement with the feed roller 20 to form a nip therebetween. The retard roller 30 is rotatively mounted on and supported by a shaft 34 using a hub or bearing 32.

Figure 1B:
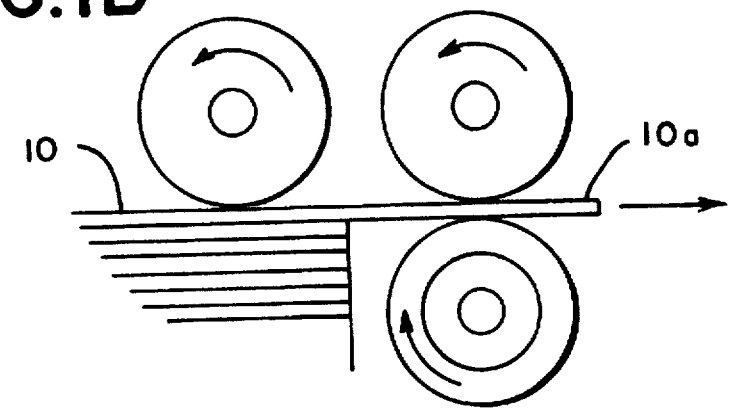
FIG. 1B is a simplified illustration of a front view of a sheet feeder in accordance with a first embodiment of the present invention showing a single sheet in a nip between a feed roller and a retard roller.

With the structure now defined, the operational and functional characteristics will now be described. Referring to FIG. 1B, the situation where the nudger roller 12 advances a single sheet 10*a* to the nip between the feed roller 20 and the retard roller 30 is shown. In this situation, it is desirable for the retard roller 30 to rotate cooperatively with the feed roller 20 as indicated by the arrows. For this to occur, the system must possess particular parameters dependent upon the forces and coefficients of friction of the various components.

Assuming no slip between the retard roller 30 and the sheet 10*a* and ignoring the effects of the nudger roller 12, the force at the nip is given by:

$$\mu_{PR}F_N \geq F_R \tag{1}$$

where $\mu_{PR}$ is the coefficient of friction between the sheet 10*a* and the retard roller 30, $F_N$ is the force with which the retard roller 30 is biased toward the feed roller 20 and $F_R$ is the retarding force on the sheet 10*a* or the tangential force acting on the surface of the retard roller 30. The retarding force $F_R$ causes a torque which is given by:

$$F_R R_O = T_1 \tag{2}$$

where $R_O$ is the distance from the axis of the shaft 34 to the nip or the surface of the retard roller 30 and $T_1$ is the resulting torque on the retard roller 30 about the shaft 34. Substituting for $F_R$ in equation #2 using equation #1 yields:

$$\mu_{PR}F_N R_O \geq T_1 \tag{3}$$

In order for the retard roller 30 to rotate, the torque $T_1$ must overcome the frictional forces at the bearing 32 which are given by:

$$\mu_{BS}F_N R_I = T_1 \tag{4}$$

where $\mu_{BS}$ is the coefficient of friction between the bearing 32 and the shaft 34 and $R_I$ is the distance from the axis of the shaft 34 to the bearing 32 and the shaft 34 interface (where the inside radius of the bearing 32 contacts the outside radius of the shaft 34). Thus, the torque necessary to induce rotation of the retard roller 30 must be less than $T_1$. Substituting for $T_1$ in equation #4 using equation #3 yields:

$$\mu_{BS}F_N R_I < \mu_{PR}F_N R_O \tag{5}$$

Thus, so long as equation #5 is satisfied, the retard roller 30 will rotate cooperatively with the feed roller 20.

Figure 1C:
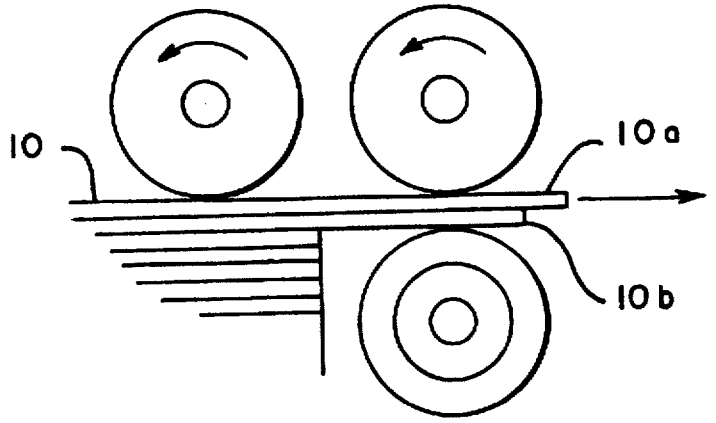
FIG. 1C is a simplified illustration of a front view of a sheet feeder in accordance with a first embodiment of the present invention showing two sheets in a nip between a feed roller and a retard roller.

Referring to FIG. 1C, a multi-feed situation is shown. The nudger roller 12 advances two sheets, an upper sheet 10*a* and a lower sheet 10*b*, into the nip between the feed roller 20 and the retard roller 30. As discussed above, a variety of reasons exist which may cause this to occur, such as: friction between the sheets 10*a* and 10*b*, excessive static electricity or excessive humidity. In this situation, the retard roller 30 does not rotate and prevents the lower sheet 10*b* which is against the retard roller 30 from feeding downstream while the feed roller 20 advances the upper sheet 10*a* downstream.

For the upper sheet 10*a* and the lower sheet 10*b* to properly separate, the following must hold:

$$\mu_{PP}F_N R_O < \mu_{BS}F_N R_I \tag{6}$$

where $\mu_{PP}$ is the coefficient of friction between the upper sheet 10*a* and the lower sheet 10*b* and the other terms are as defined above. Thus, the frictional force between the upper and lower sheets 10*a* and 10*b* ($\mu_{PP}F_N R_O$) must be overcome by the retarding force ($\mu_{BS}F_N R_I$) due to the frictional force between the bearing 32 and the shaft 34 so that separation of the sheets 10*a* and 10*b* occurs.

Therefore, if the conditions of equation #5 and equation #6 are met, the retard roller 30 will operate as desired. That is, the retard roller 32 rotates in cooperation with the feed roller 20 when a single sheet is present in the nip and the retard roller 32 does not rotate when multiple sheets are present in the nip. Accordingly, equations #5 and #6 may be combined to yield the following expression which consists of both conditions:

$$\mu_{PP}F_NR_O<\mu_{BS}F_NR_f<\mu_{PR}F_NR_O \quad (7)$$

Equation #7 may be simplified and rearranged by dividing all terms by $F_NR_O$ which yields:

$$\mu_{PP}<\mu_{BS}R_f/R_O<\mu_{PR} \quad (8)$$

It should now be apparent to those skilled in the art that the performance of the retard roller 30 may be controlled by ensuring that equation #8 is satisfied.

Those skilled in the art will recognize that the performance of the retard roller 30 is dependent on the design of relevant coefficients of friction and overall system geometry. The coefficient of friction $\mu_{PP}$ between the upper sheet 10*a* and the lower sheet 10*b* depends on the characteristics of the paper being used and is even variable from sheet to sheet of the same stock. Additionally, factors such as the type of paper stock and the surface finish influence the coefficient of friction $\mu_{PP}$ between the upper sheet 10*a* and the lower sheet 10*b*. Typically, for most commercial grades of paper, the coefficient of friction $\mu_{PP}$ ranges from 0.15 to 0.35. The coefficient of friction $\mu_{PR}$ between the sheet 10*a* and the feed roller 20 depends on the paper characteristics and the material properties of the feed roller 20. Generally, the feed roller 20 is made of a suitable rubber-like material, such as urethane having a durometer of approximately in the range of 30 to 60, so that the feed roller 20 properly grabs the sheet 10*a*. As a result, the coefficient of friction $\mu_{PR}$ typically ranges from 1.00 to 2.00.

Therefore, to achieve the desired system performance, the retard roller 30, bearing 32 and the shaft 34 must be designed so that the middle term of equation #8, $\mu_{BS}R_f/R_O$, is greater than about 0.65 and less than about 1.00. For purposes of discussion, this middle term is referred to as an effective coefficient of friction $\mu_{EFF}$ since it is derived from the coefficient of friction $\mu_{BS}$ between the bearing 32 and the shaft 34 multiplied by a term $R_f/R_O$ which is derived from the geometric design of the retard roller 30, the bearing 32 and the shaft 34. Since $R_f/R_O$, will always be less than one, the coefficient of friction $\mu_{BS}$ must be suitably high enough so that equation #8 is satisfied. For example, if $R_f/R_O$ were equal to 0.50, then the coefficient of friction $\mu_{BS}$ would need to be between 1.30 and 2.00 so that the effective coefficient of friction $\mu_{EFF}$ of equation #8 would be satisfied for the ranges provided above for the coefficients of friction $\mu_{PP}$ and $\mu_{PR}$, respectively.

Those skilled in the art will recognize that this first embodiment requires a large amount of friction between the bearing 32 and the shaft 34. Although it is possible to design the bearing 32 and the shaft 34 to achieve a coefficient of friction $\mu_{BS}$ between 1.30 and 2.00, it would not be suited to a high volume environment. Friction at these levels would lead to wear and heat generation inappropriate for high volume environments and thus only practical for low volume environments where the paper stock being used permitted the selection of suitable bearing and shaft materials.

Figure 2:
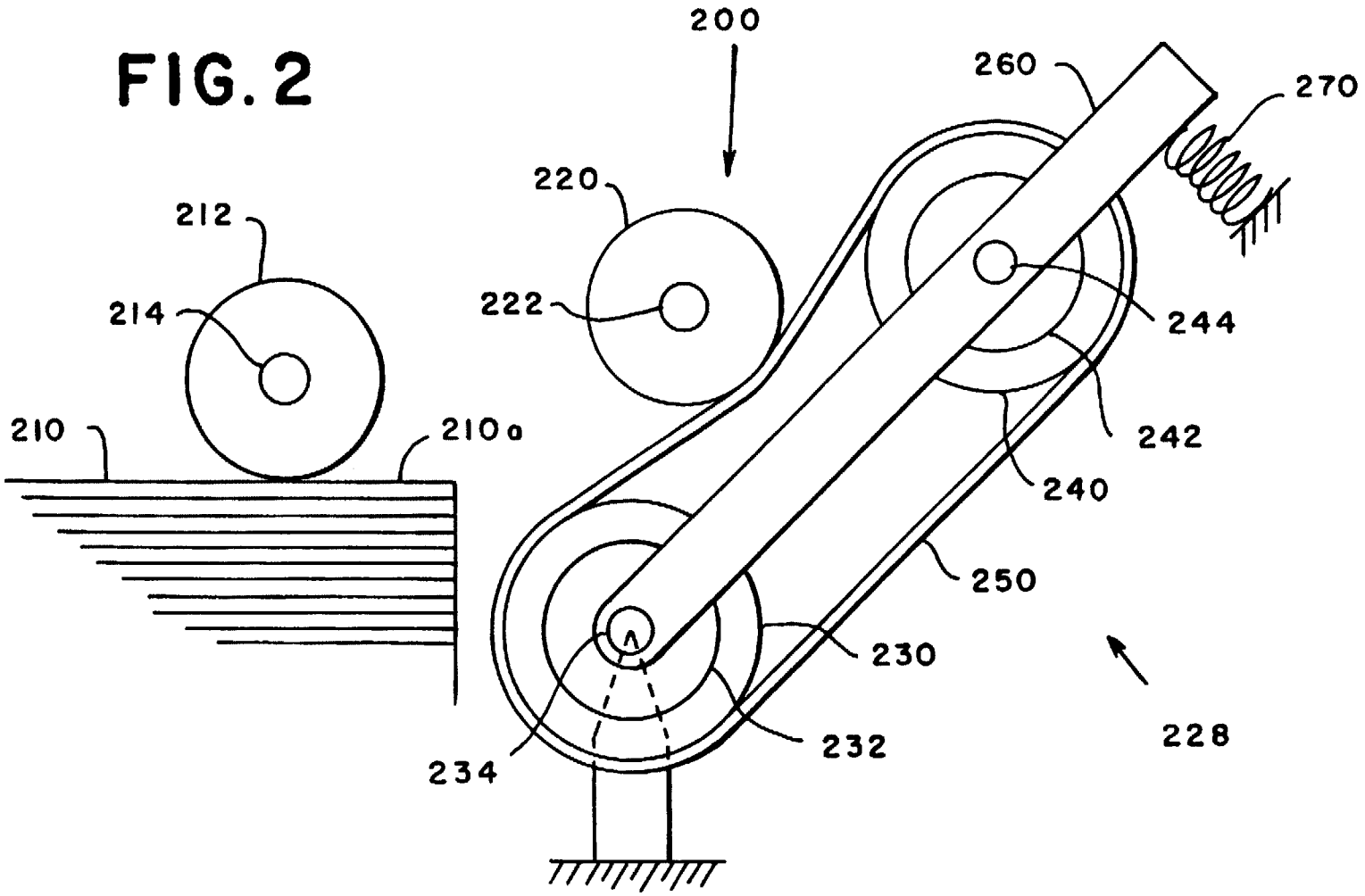
FIG. 2 is a simplified illustration of a front view of a sheet feeder in accordance with a second embodiment of the present invention.

In keeping with the concept of the present invention, a sheet feeder 200 according to a second embodiment is shown in FIG. 2. The sheet feeder 200 is more particularly suited to high volume sheet feeding environments. The prefeed and feed portions of sheet feeder 200 are substantially identical to those of the sheet feeder 100. A nudger roller 212 is fixably mounted to a shaft 214 and positioned to contact a stack of sheets 210. The shaft 214 is connected to a conventional drive means (not shown) to cause the nudger roller 212 to rotate in a counter-clockwise direction in response to a sheet feed instruction supplied by a suitable control system (not shown). Generally, a conventional biasing means, such as a spring (not shown) and/or a stack elevator (not shown), keeps the nudger roller 212 in intimate contact with a top sheet 210*a* of the stack 210. As the nudger roller 212 rotates, frictional forces between the nudger roller 212 and the top sheet 210*a* cause the top sheet 210*a* to move off the stack 210. Located downstream from the nudger roller 212 is a feed roller 220 which is fixably mounted to a shaft 220 which is connected to a conventional drive means (not shown) to cause the feed roller 220 to rotate in a counter-clockwise direction in either continuous fashion or in relation to the sheet feed instruction which actuates the nudger roller 212.

The second embodiment differs from the first embodiment primarily in two aspects of how the retard function is implemented. A retard system 228 includes a pair of pulleys 230 and 240 each fixably mounted to respective bearings or hubs 232 and 242 which are each in turn mounted to respective shafts 234 and 244. An endless belt 250 extends around the pulleys 230 and 240 so as to come into contact with the feed roller 220 forming a nip therebetween. The shaft 234 is rotatively mounted in any suitable structure, such as a frame (not shown), at each end by conventional means. This is shown diagrammatically in FIG. 2. One end of a support arm 260 is pivotally mounted to the shaft 234. The other end of arm 260 is connected to a compression spring 270 so as to bias the retard system 228, particularly the belt 250, into engagement with the feed roller 220. The shaft 244 is fixably mounted along the span of arm 260 at each end.

In similar fashion to the first embodiment, bearing design and system geometry are defined so that the belt 250 rotates along with the feed roller 220 when a single sheet 210*a* is present in the nip and the belt 250 does not rotate when a plurality of sheets are present.

Figure 3:
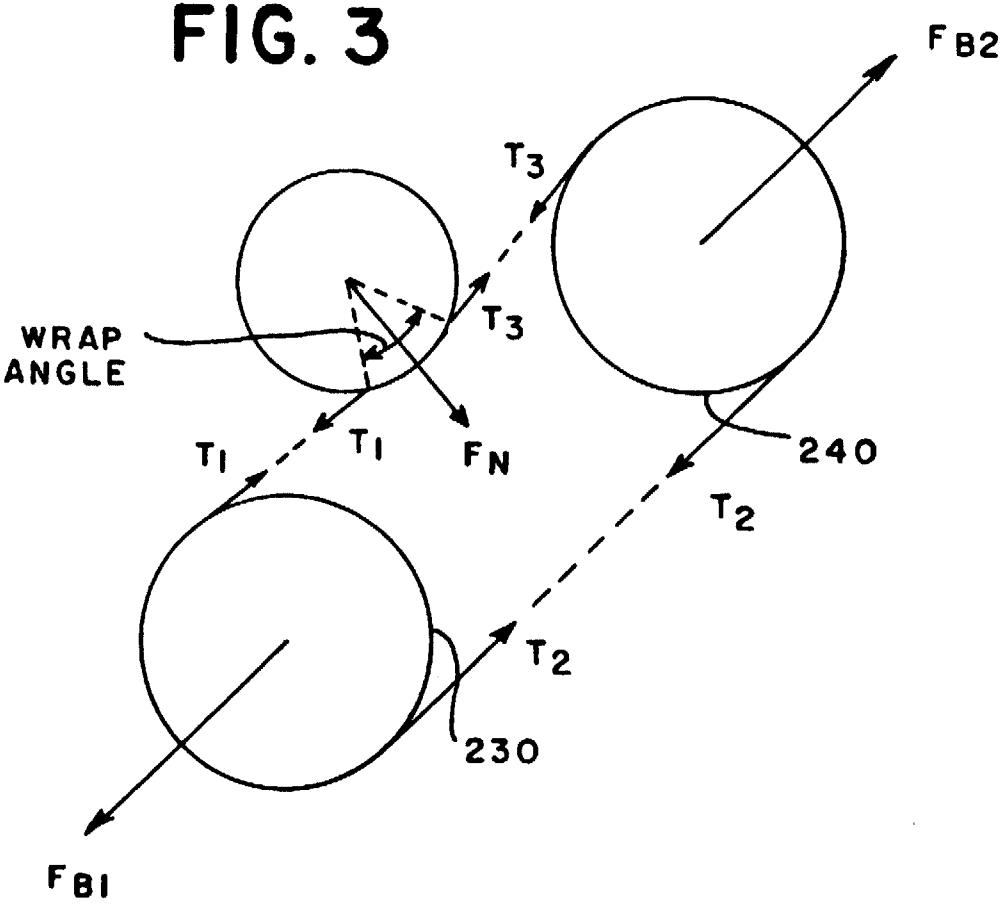
FIG. 3 is a simplified illustration of a free body diagram of the sheet feeder of FIG. 2.

Referring to FIGS. 2 and 3, in contrast to the first embodiment, the reaction forces $F_{B1}$ and $F_{B2}$ at the bearings 232 and 242, respectively, are not equal to the normal force $F_N$ supplied by the spring 270. This is due to tensile forces $T_1$, $T_2$, and $T_3$ induced on respective spans of the belt 250 by the engagement of the feed roller 220 with the belt 250 due to compression of the spring 270. The magnitude of the tensile forces $T_1$, $T_2$, and $T_3$ is governed not only by the spring 270, but also by the wrap angle (amount of angular engagement of the belt 250 around the surface of feed roller 220). Generally, because feed roller 220 rotates counter-clockwise, it can be assumed that:

$$T_1>T_2>T_3 \quad (9)$$

Therefore, the reaction forces at the bearings 232 and 242 must balance the normal force $F_N$ and the tensile forces $T_1$, $T_2$, and $T_3$ in the belt 250. This has the effect of substantially increasing the forces at the bearings 232 and 242 for the same normal force $F_N$ as provided in the first embodiment.

Because the bearing forces are increased, the coefficient of friction $\mu_{BS}$ can be reduced to values more appropriate for high volume applications while still achieving a desired effective coefficient of friction $\mu_{EFF}$. That is, the second embodiment is governed by an equation analogous to equation #8 of the first embodiment which is governed by the system geometry. The derivation of $\mu_{EFF}$ for the second embodiment is set forth below.

Assuming that the spans of the belt 250 are substantially parallel, the sum of the forces acting on the bearing 232 can be simplified to:

$$T_1+T_2=F_{B1} \tag{9}$$

where $T_1$ is the tensile force on a first span of belt 250, $T_2$ is the tensile force on a second span of belt 250 and $F_{B1}$ is the reaction force at bearing 232. Thus, any non-parallel components due to the slight difference in wrap angle in the belt 250 caused by contact with the feed roller 220 are assumed to be negligible. In similar fashion, the sum of the forces acting on the bearing 242 can be simplified to:

$$T_2+T_3=F_{B2} \tag{10}$$

where $T_3$ is the tensile force on a third span of belt 250 and $F_{B2}$ is the reaction force at bearing 242.

In order for pulley 230 to rotate, the sum of the torques acting on the bearing 232 are given by:

$$T_1=T_2+F_{B1}(\mu_{BS}R_I/R_O) \tag{11}$$

where $\mu_{BS}$ is the coefficient of friction between the bearing 232 and the shaft 234, $R_I$ is the distance from the axis of the shaft 234 to the bearing 232 and $R_O$ is the distance from the axis the shaft 234 to the pitch line of the belt 250. Substituting equation (9) for $F_{B1}$ yields:

$$T_1=T_2+(T_1+T_2)*(\mu_{BS}R_I/R_O) \tag{12}$$

Rearranging terms and solving for $T_1$ yields:

$$T_1=T_2[(1+\mu_{BS}R_I/R_O)/(1-\mu_{BS}R_I/R_O)] \tag{13}$$

Since the expression:

$$[(1+\mu_{BS}R_I/R_O)/(1-\mu_{BS}R_I/R_O)] \tag{14}$$

is a constant which is only dependent on system geometry and bearing design, equation #13 can be rewritten as:

$$T_1=KT_2 \tag{15}$$

where K is a constant equal to the term expressed in equation #14. Using the same approach, it can be found that:

$$T_2=KT_3 \tag{16}$$

Now, substituting for $T_2$ in equation #15 using equation #16 yields:

$$T_1=L^2T_3 \tag{17}$$

The forces acting at the interface between the feed roller 220 and the belt 250 will now be considered. Assuming that $F_N$ bisects the wrap angle θ, the following must hold:

$$F_N=T_1\sin(\theta/2)+T_3\sin(\theta/2) \tag{18}$$

where $F_N$ is the normal force induced by the spring 270. Those skilled in the art will recognize that the retarding force $T_1$ is the tension is the first span as equal to the difference between the tensions in the belt 250 upstream from the nip and downstream from the nip and is given by:

$$R_R=T_1-T_3 \tag{19}$$

where $T_1$ is the tension is the first span and $T_3$ is the tension is the third span. This difference in tension represents the traction force required to rotate the belt and represents the maximum retarding force exerted by the belt.

In more general terms, the retarding force $F_R$ may be expressed as:

$$F_R=\mu_{EFF}F_N \tag{20}$$

where $\mu_{EFF}$ is a term dependent upon the second embodiment's specific geometry and bearing design. Solving equation #20 for $\mu_{EFF}$ and substitution for $F_R$ and $F_N$ using equations #19 and #18, respectively, yields:

$$\mu_{EFF}=(T_1-T_3)/[T_1\sin(\theta/2)+T_3\sin(\theta/2)] \tag{21}$$

Substituting for $T_1$ using equation #17 and simplifying yields:

$$\mu_{EFF}=(K^2-1)/[(K^2+1)(\sin(\theta/2))] \tag{22}$$

It should now be apparent that $\mu_{EFF}$ is only a function of system geometry and bearing design. Therefore, by properly designing the system geometry and selecting bearing materials, any desired $\mu_{EFF}$ can be achieved.

Those skilled in the art will recognize that the second embodiment allows for use of more conventional bearing relationships while achieving a desired $\mu_{EFF}$. As discussed above, an appropriate range for $\mu_{EFF}$ is about 0.65 to about 1.00. Therefore, for example, if it was desired to have a $\mu_{EFF}$ of 0.70, then the system geometry, ratio $R_I/R_O$ and the coefficient of friction $\mu_{BS}$ could be established to achieve to achieve this. Thus, if $R_I/R_O$ equals 0.50 and the wrap angle θ equals 30 degrees, then using the equations above it can be shown that a $\mu_{BS}$ of 0.18 would achieve the desired $\mu_{EFF}$ of 0.70. As a result, a $\mu_{BS}$ of 0.18 allows for the use of more conventional materials for the bearings 232 and 242 and shafts 234 and 244 so that wear and heat generation are reduced. In the preferred embodiment, the bearings should be designed with a $\mu_{BS}$ in the range of about 0.10 to 0.30. Many suitable and conventional materials are available for the shafts 234 and 244 and the bearings 232 and 242 which would yield a coefficient of friction in this range, such as steel and plastic or brass, respectively. The result is improved life cycle characteristics and performance in high volume environments.

The second embodiment has the additional benefit of singulating along a curved path. The engagement of the belt 250 around the periphery of the feed roller 220 produces a retard zone with a circular path. This requires sheets fed from stack 210 to bend as they are advance through the retard zone. If a plurality of sheets enters the retard zone, then the resulting bending of the sheets induces a shearing force at the lead edge of the sheets which assists in separating them.

Figure 4:
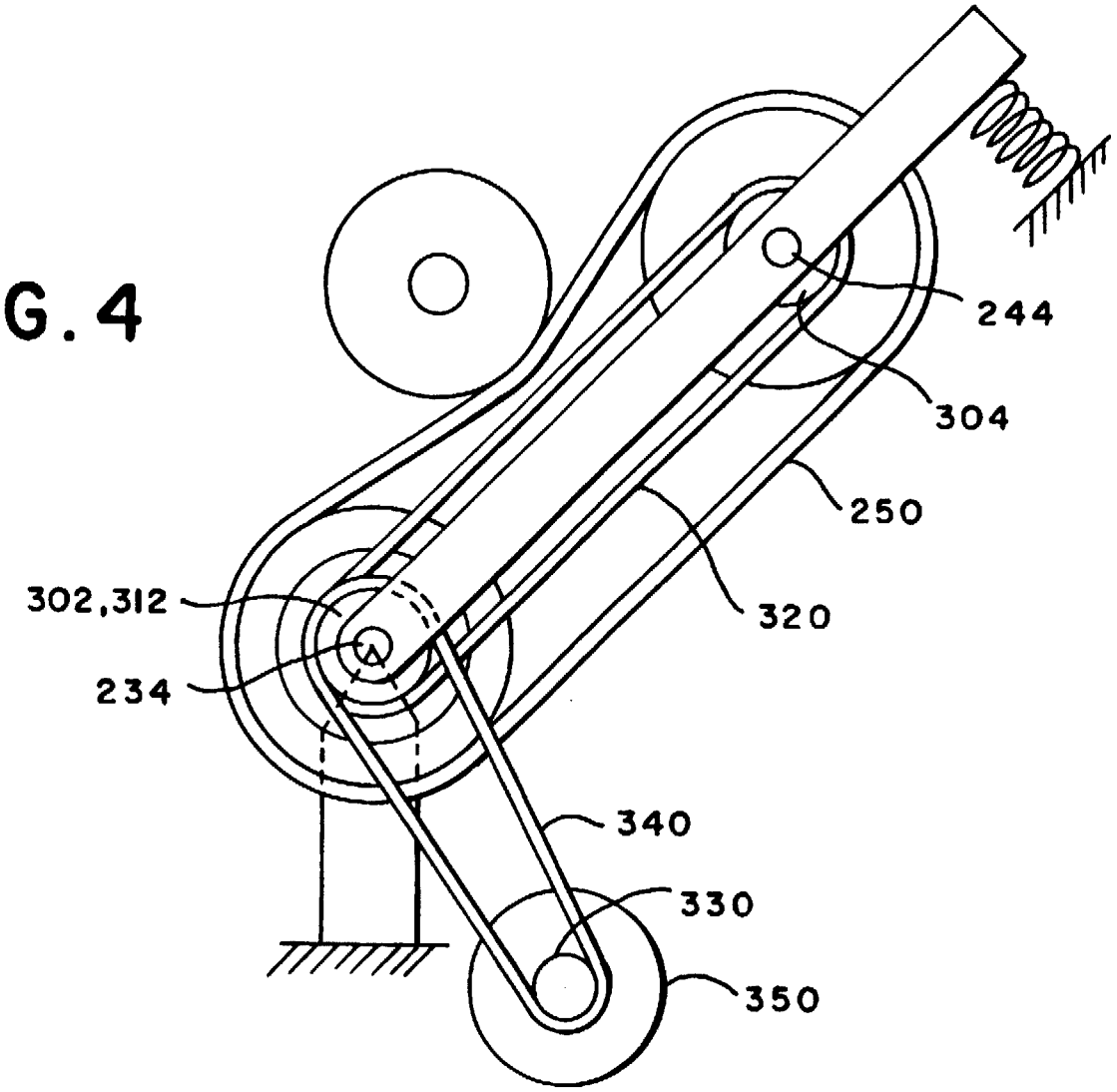
FIG. 4 is a simplified illustration of a front view of a sheet feeder in accordance with a third embodiment of the present invention.

Referring to FIG. 4, a third embodiment of the present invention is shown. The third embodiment is substantially similar to the second embodiment except that the retard system is active instead of passive. This active system works to eject multi-fed sheets from the nip rather than merely retarding them. The belt 250 is driven in a counter-clockwise direction in opposition to the feed direction of the sheets. Fixably mounted on the shaft 234 are a plurality of laterally spaced pulleys 302 and 312. Fixably mounted on the shaft 244 is a pulley 304. A first endless belt 320 extends around pulleys 302 and 304 while a second timing endless belt 340 extends around the pulley 312 and a pulley 330 which is operatively connected to the output shaft of a motor 350. In this manner, the motor 350 drives shafts 234 and 244 in synchronization.

Additionally, the third embodiment provides for a more uniform a $\mu_{BS}$. This is because $\mu_{BS}$ is solely a kinetic coefficient of friction in an active system. Therefore, the differences between static and kinetic coefficients of friction and stiction associated with stopping and starting are avoided.

Because additional advantages of the present invention and modifications to the present invention will readily occur to those skilled in the art, the invention in its broader aspects is not limited to the specific details of the preferred embodiments. For example, the feed roller as described in the various embodiment may be easily replaced with an O-ring or endless belt type of feed system. Accordingly, those skilled in the art will recognize still further modifications that may be made without departing from the spirit of the general inventive concept as defined by the appended claims and their equivalents.

What is claimed is:

1. A sheet feeder comprising:

a rotateable feed roller for feeding sheets in a path of travel; and retarding means operatively coupled with the feed roller for forming a nip therebetween, the retarding means and the rotateable feed roller arranged to define a system geometry, the retarding means having an effective coefficient of friction and including:

a pair of pulleys in spaced apart relationship and disposed on either side of the feed roller;

means operatively disposed between the pair of pulleys and coupled with the feed roller for gripping the sheets; and bearing means for providing the pair of pulleys with rotational capability, the bearing means having a coefficient of friction in the range of about 0.10 to about 0.30;

and wherein:

the combination of the system geometry and the bearing means coefficient of friction yield the effective coefficient of in the range of about 0.65 to about 1.00 which is greater than the coefficient of friction between the sheets and less than the coefficient of friction between the feed roller and the single sheet so that the gripping means rotates along with the feed roller when a single sheet is in the nip and the gripping means does not rotate along with the feed roller when a plurality of sheets are in the nip.

2. The sheet feeder of claim 1 comprising:

means for biasing the retarding means toward the feed roller; and wherein the gripping means includes an endless belt which conforms to a portion of the feed roller to form a curved path so that a shearing force is produced between the sheets which are separated along the curved path.

3. The sheet feeder of claim 1 further comprising:

drive means operatively coupled with the retard means for applying a driving force tending to rotate the gripping means in a direction opposite to the feed roller; and wherein when the single sheet is in the nip the driving force is overcome by friction so that the gripping means rotates along with the feed roller and when the plurality of sheets are in the nip the driving force is not overcome by friction so that the gripping means rotates opposite to the feed roller to eject a bottom sheet in contact with the gripping means from the nip.

4. The sheet feeder of claim 2 further comprising:

drive means operatively coupled with the retard means for applying a driving force tending to rotate the gripping means in a direction opposite to the feed roller; and wherein when the single sheet is in the nip the driving force is overcome by friction so that the gripping means rotates along with the feed roller and when the plurality of sheets are in the nip the driving force is not overcome by friction so that the gripping means rotates opposite to the feed roller to eject a bottom sheet in contact with the gripping means from the nip.

* * * * *